US012365967B1

(12) United States Patent
Zhong et al.

(10) Patent No.: US 12,365,967 B1
(45) Date of Patent: Jul. 22, 2025

(54) TUNGSTEN WIRE CONTAINING LANTHANUM, RHENIUM AND YTTRIUM AND PREPARATION METHOD THEREOF

(71) Applicant: Chongyi Zhangyuan Tungsten Co., Ltd, Chongyi (CN)

(72) Inventors: Wei Zhong, Chongyi (CN); Yanyuan Tang, Chongyi (CN); Feng Xiao, Chongyi (CN); Renchun Yang, Chongyi (CN); Chengwen Lei, Chongyi (CN); Kaihui Chen, Chongyi (CN)

(73) Assignee: Chongyi Zhangyuan Tungsten Co., Ltd, Chongyi (CN)

( * ) Notice: Subject to any disclaimer, the term of this patent is extended or adjusted under 35 U.S.C. 154(b) by 0 days.

(21) Appl. No.: 18/965,813

(22) Filed: Dec. 2, 2024

(51) Int. Cl.
*C22C 1/04* (2023.01)
*C22C 27/04* (2006.01)
*C22F 1/18* (2006.01)

(52) U.S. Cl.
CPC ..... *C22C 27/04* (2013.01); *C22C 1/045* (2013.01); *C22F 1/18* (2013.01)

(58) Field of Classification Search
CPC ..... C22C 27/04; C22C 1/045; C22F 1/18
See application file for complete search history.

(56) References Cited

FOREIGN PATENT DOCUMENTS

| | | | |
|---|---|---|---|
| CN | 103849804 | A | 6/2014 |
| CN | 110026561 | A | 7/2019 |
| CN | 114888292 | A | 8/2022 |
| CN | 116970854 | A | 10/2023 |
| JP | 2002371301 | A | 12/2002 |

*Primary Examiner* — Jessee R Roe

(57) ABSTRACT

The present disclosure relates to the technical field of powder metallurgy, especially to a tungsten wire containing lanthanum, rhenium and yttrium and preparation method thereof. It ensures the uniform distribution of the lanthanum and the yttrium by doping the lanthanum and the yttrium in manner of liquid to liquid. W—La—Y compound powder with uniform composition distribution is obtained after oxidizing process. Rhenium element loss caused by rhenium oxides formation at early stage of oxidizing process is avoided by mixing rhenium at late stage which also ensures effective addition of the rhenium element. The uniform composition distribution decreases property decay caused by stress concentration formed by doping elements. Tension strength and fatigue resistance property of the tungsten wire are improved. The tension strength of the tungsten wire containing lanthanum, rhenium and yttrium according to the present disclosure is 4600-6000 MPa. Fatigue cycles to failure of fatigue resistance test at 4000 MPa is not less than 65000.

5 Claims, 2 Drawing Sheets

TUNGSTEN WIRE CONTAINING LANTHANUM, RHENIUM AND YTTRIUM AND PREPARATION METHOD THEREOF

CROSS-REFERENCE TO RELATED APPLICATIONS

This application claims priority to Chinese Patent No. 202410100069.5 with a filing date of Jan. 24, 2024. The content of the aforementioned application, including any intervening thereto, is incorporated herein by reference.

TECHNICAL FIELD

This disclosure relates to a technical field of powder metallurgy, especially to a tungsten wire containing lanthanum, rhenium and yttrium and a preparation method thereof.

BACKGROUND OF THE INVENTION

Tungsten diamond wire with property of high hard and strength, high temperature resistance and erosion resistance applied in the silicon cutting field, makes up and improves the inefficiency of carbon steel diamond wire. It promotes advance and upgrading of technology and equipment in crystalline silicon field, and then enhances the superior position of our country in photovoltaic industry.

Based on the property requirement of tungsten wire during silicon slice cutting process, doping tungsten wire which refers to a tungsten wire made by adding moderate metallic elements like K, Na, Al, La, Re, Co into pure tungsten wire is used as diamond base wire in most tungsten diamond wire. Tension strength of the doping tungsten wire mentioned above is higher than pure tungsten wire. Tension strength and fatigue resistance property of the doping tungsten wire mentioned above are high. However, nonuniform composition distribution during doping process leads unstable property of alloy. It also leads to property of tungsten wire not meeting the expected effect due to bad timing of doping process.

SUMMARY OF THE INVENTION

In order to solve the problems in prior art, the main subject of the present disclosure is to provide a tungsten wire containing lanthanum (La), rhenium (Re) and yttrium (Y) and a preparation method thereof.

In order to solve the problems mentioned above, according to one aspect of the present disclosure, a following technical solution is provided.

A preparation method of tungsten wire containing lanthanum, rhenium and yttrium contains following steps;

S1, dissolving water-soluble tungsten source, lanthanum source and yttrium source in water, stirring them well to obtain an aqueous solution;

S2, spray granulating the aqueous solution to obtain W—La—Y compound powder;

S3, oxidizing calcinating the compound powder to obtain W—La—Y oxide compound powder;

S4, adding rhenium to the W—La—Y oxides compound powder by spraying the W—La—Y oxide compound powder with rhenium solution and then mixing them to obtain W—La—Y oxide compound powder containing Re;

S5, reducing the W—La—Y oxide compound powder containing Re by hydrogen to obtain tungsten powder containing La—Y—Re;

S6, putting the tungsten powder containing La—Y—Re into a mold for isostatic pressing molding to obtain a pressed shape;

S7, sintering the pressed shape, and then producing tungsten rod with a diameter of 19.5±0.3 mm;

S8, heating and then rolling the tungsten rod in the step S7 to obtain tungsten rod with a diameter of 9±0.5 mm;

S9, treating the tungsten rod in the step S8 with cryogenic treatment, and then forging it to obtain tungsten rod with a diameter of 3.5±0.2 mm;

S10, wiredrawing the tungsten rod in the step S9 to obtain a tungsten wire containing lanthanum, rhenium and yttrium.

As a preferable embodiment of the preparation method of tungsten wire containing lanthanum, rhenium and yttrium, according to the present disclosure, wherein in the step S1, a mass ratio of tungsten in the tungsten source:lanthanum in the lanthanum source:yttrium in the yttrium source is (95.2-99.5):(2.2-2.9):1.

As a preferable embodiment of the preparation method of tungsten wire containing lanthanum, rhenium and yttrium, according to the present disclosure, wherein in the step S2, temperature of the spray granulating is 165-195° C.

As a preferable embodiment of the preparation method of tungsten wire containing lanthanum, rhenium and yttrium, according to the present disclosure, wherein in the step S3, the calcinating proceeds in stages;

Temperature and temperature maintaining time of first calcinating stage are 450-540° C. and 50-100 min respectively;

Temperature and temperature maintaining time of second calcinating stage are 950-990° C. and 90-160 min respectively.

As a preferable embodiment of the preparation method of tungsten wire containing lanthanum, rhenium and yttrium, according to the present disclosure, wherein in the step S4, adding the rhenium by a mass ratio of the lanthanum to the rhenium of (3.3-3.6):1.

As a preferable embodiment of the preparation method of tungsten wire containing lanthanum, rhenium and yttrium, according to the present disclosure, wherein in the step S5, reducing temperature is 1120-1180° C. Hydrogen flow is 20-28 L/min.

As a preferable embodiment of the preparation method of tungsten wire containing lanthanum, rhenium and yttrium, according to the present disclosure, wherein in the step S6, pressure of the isostatic pressing is 80-120 MPa.

As a preferable embodiment of the preparation method of tungsten wire containing lanthanum, rhenium and yttrium, according to the present disclosure, wherein in the step S7, sintering temperature is 2400-2600° C. Atmosphere of sintering is hydrogen. Hydrogen flow is 2-5 L/min.

As a preferable embodiment of the preparation method of tungsten wire containing lanthanum, rhenium and yttrium, according to the present disclosure, wherein in the step S8, heating the tungsten to 2400-2600° C., and then rolling it.

As a preferable embodiment of the preparation method of tungsten wire containing lanthanum, rhenium and yttrium, according to the present disclosure, wherein in the step S9, the cryogenic treatment is cooling to −175~−178° C. at a rate of 1.5-2.5° C./min and then maintaining for 80-110 min.

As a preferable embodiment of the preparation method of tungsten wire containing lanthanum, rhenium and yttrium, according to the present disclosure, wherein in the step S9, a feeding speed of the forging is 0.6-3 m/min. A forging speed is 1000-3000 times/min.

As a preferable embodiment of the preparation method of tungsten wire containing lanthanum, rhenium and yttrium, according to the present disclosure, wherein in the step S10, the tungsten wire with a diameter of above 10 μm can be obtained by various molds.

In order to solve the problems mentioned above, according to another aspect of the present disclosure, a following technical solution is provided.

A tungsten wire containing lanthanum, rhenium and yttrium is prepared by the above-mentioned preparation method of tungsten wire containing lanthanum, rhenium and yttrium, according to the present disclosure.

As a preferable embodiment of the tungsten wire containing lanthanum, rhenium and yttrium, according to the present disclosure, wherein tension strength of the tungsten wire containing lanthanum, rhenium and yttrium is 4600-6000 MPa. Fatigue cycles to failure of fatigue resistance test at 4000 MPa is not less than 65000. The advantages of the present disclosure are as follows.

The present disclosure provides a tungsten wire containing lanthanum, rhenium and yttrium and a preparation method thereof, which ensures a uniform distribution of the lanthanum and the yttrium by doping the lanthanum and the yttrium in manner of liquid to liquid. W—La—Y compound powder with uniform composition distribution is obtained after oxidizing process. Rhenium element loss caused by rhenium oxides formation at early stage of oxidizing process is avoided by mixing rhenium at late stage which also ensures effective addition of the rhenium element. The uniform composition distribution decreases property decay caused by stress concentration formed by doping elements. Tension strength and fatigue resistance property of the tungsten wire are improved. The tension strength of the tungsten wire containing lanthanum, rhenium and yttrium according to the present disclosure is 4600-6000 MPa. Fatigue cycles to failure of fatigue resistance test at 4000 MPa is not less than 65000.

BRIEF DESCRIPTION OF THE DRAWINGS

In order to more clearly illustrate the technical solutions in the present disclosure or prior art, drawings are used in the embodiments or the description of the prior art will be briefly introduced below. It should be understood that, the drawings in the following description are only examples of the present disclosure. For those skilled persons in the art, other drawings can be obtained on these drawings without creative works.

DETAILED DESCRIPTION OF THE INVENTION

Figure 1:
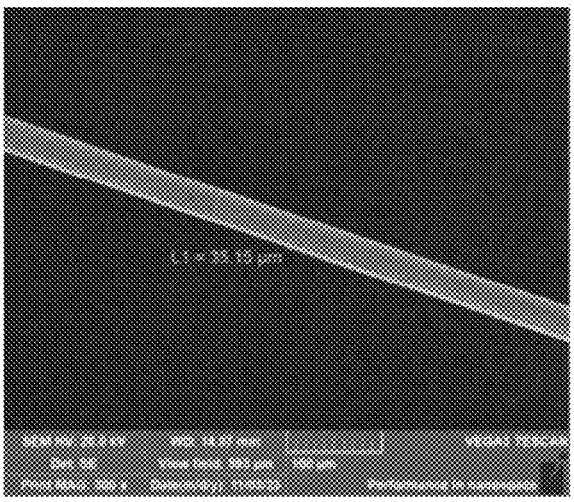
FIG. 1 is a perspective view of the tungsten wire prepared by Example 1.

A clear and complete description is made below in conjunction with the technical solutions in the embodiments. Apparently, the described embodiments are only some of the embodiments of the present disclosure, but not all of them. Based on the embodiments of the present disclosure, all other embodiments obtained by persons of ordinary skilled in the art without creative efforts fall within the scale of claims in the present disclosure.

The advantages of the tungsten wire containing lanthanum, rhenium and yttrium and the preparation method thereof provided by the present disclosure are as follows;

(1) The lanthanum and the yttrium are doped uniformly by doping the lanthanum and the yttrium in manner of liquid to liquid. W—La—Y compound powder with uniform composition distribution is obtained after oxidizing process.

(2) Rhenium element loss caused by rhenium oxides formation at early stage of oxidizing process is avoided by mixing rhenium at late stage which also ensures effective addition of the rhenium element.

(3) The uniform composition distribution decreases property decay caused by stress concentration formed by doping elements. Tension strength and fatigue resistance property of the tungsten wire are improved.

(4) The ratio of La:Y:Re is controlled by the present disclosure, which further improves the tension strength of the tungsten wire.

(5) The cryogenic treatment is performed in the present disclosure, which effectively decreases inner stress during forging, increases forging speed and decreases probability of tungsten wire cracking.

According to one aspect of the present disclosure, the following technical solution is provided.

A preparation method of tungsten wire containing lanthanum, rhenium and yttrium contains following steps;

S1, dissolving water soluble tungsten source, lanthanum source and yttrium source in water, stirring them well to obtain an aqueous solution;

S2, spray granulating the aqueous solution to obtain W—La—Y compound powder;

S3, oxidizing calcinating the compound powder to obtain W—La—Y oxide compound powder;

S4, determining La content of W—La—Y oxide compound powder; adding rhenium to the W—La—Y oxides compound powder by spraying the W—La—Y oxide compound powder with rhenium solution and then mixing them to obtain W—La—Y oxide compound powder containing Re;

S5, reducing the W—La—Y oxide compound powder containing Re by hydrogen to obtain tungsten powder containing La—Y—Re;

S6, putting the tungsten powder containing La—Y—Re into a mold for isostatic pressing molding to obtain a pressed shape;

S7, sintering the pressed shape, and then producing tungsten rod with a diameter of 19.5±0.3 mm;

S8, heating and then rolling the tungsten rod in the step S7 to obtain tungsten rod with a diameter of 9±0.5 mm;

S9, treating the tungsten rod in the step S8 with cryogenic treatment, and then forging it to obtain tungsten rod with a diameter of 3.5±0.2 mm;

S10, wiredrawing the tungsten rod in the step S9 to obtain tungsten wire containing lanthanum, rhenium and yttrium.

Furthermore, wherein in the step S1, a mass ratio of tungsten in the tungsten source:lanthanum in the lanthanum source:yttrium in the yttrium source is (95.2-99.5):(2.2-2.9):1. The water-soluble tungsten source, lanthanum source and yttrium source include ammonium paratungstate, lanthanum nitrate and yttrium acetate. The lanthanum and the yttrium are doped uniformly by doping the lanthanum and the yttrium in manner of liquid to liquid. W—La—Y compound powder with uniform composition distribution is obtained after oxidizing process.

Furthermore, wherein in the step S2, temperature of the spray granulating is 165-195° C.

Furthermore, wherein in the step S3, in order to ensure completely generating W—La—Y oxide compound powder, the calcinating proceeds in stages;

Temperature and temperature maintaining time of first calcinating stage are 450-540° C. and 50-100 min respectively;

Temperature and temperature maintaining time of second calcinating stage are 950-990° C. and 90-160 min respectively.

Furthermore, wherein in the step S4, determining La content of W—La—Y oxide compound powder. Adding rhenium to the W—La—Y oxide compound powder by spraying and mixing the W—La—Y oxide compound powder and rhenium solution. The rhenium can be Ammonium perrhenate. Adding the rhenium by a mass ratio of the lanthanum to the rhenium of (3.3-3.6):1. Rhenium element loss caused by rhenium oxides formation at early stage of oxidizing process is avoided by mixing rhenium at late stage which also ensures effective addition of the rhenium element.

Furthermore, wherein in the step S5, reducing temperature is 1120-1180° C. Hydrogen flow is 20-28 L/min.

Furthermore, wherein in the step S6, pressure of the isostatic pressing is 80-120 MPa.

Furthermore, wherein in the step S7, sintering temperature is 2400-2600° C. Atmosphere of sintering is hydrogen, which can further swap oxygen. Hydrogen flow is 2-5 L/min.

Furthermore, wherein in the step S8, heating the tungsten to 2400-2600° C., and then rolling it.

Furthermore, wherein in the step S9, the cryogenic treatment is cooling to −175~−178° C. at a rate of 1.5-2.5° C./min and then maintaining for 80-110 min.

Furthermore, wherein in the step S9, a feeding speed of the forging is 0.6-3 m/min. A forging speed is 1000-3000 times/min.

Furthermore, wherein in the step S10, the tungsten wire with the diameter of above 10 μm can be obtained by various molds.

According to another aspect of the present disclosure, a following technical solution is provided.

A tungsten wire containing lanthanum, rhenium and yttrium is prepared by the above-mentioned preparation method of tungsten wire containing lanthanum, rhenium and yttrium, according to the present disclosure.

Furthermore, wherein tension strength of the tungsten wire containing lanthanum, rhenium and yttrium is 4600-6000 MPa. Fatigue cycles to failure of fatigue resistance test at 4000 MPa is not less than 65000.

Further illustration about the technical solutions of the present disclosure is showed according to examples.

Example 1

A preparation method of tungsten wire containing lanthanum, rhenium and yttrium tungsten contains following steps;

S1, ammonium paratungstate, lanthanum nitrate, and yttrium acetate were dissolved in water. The aqueous solution was obtained after stirring well. A mass ratio of tungsten:lanthanum:yttrium was 96.1:2.9:1.

S2, the aqueous solution was spray granulated to obtain W—La—Y compound powder. Temperature of the spray granulating was 182° C.

S3, the compound powder was oxidizing calcinated to obtain W—La—Y oxide compound powder. The calcinating proceeded in stages. Temperature and temperature maintaining time of first calcinating stage were 450° C. and 70 min respectively. Temperature and temperature maintaining time of second calcinating stage were 950° C. and 110 min respectively.

S4, La content of the W—La—Y oxide compound powder was determined as 0.25%. Rhenium was added to the W—La—Y oxide compound powder in manner of spraying with rhenium solution and mixing to obtain W—La—Y oxide compound powder containing Re. A mass ratio of the lanthanum to the rhenium was 3.4:1.

S5, the W—La—Y oxide compound powder containing Re was reduced by hydrogen to obtain tungsten powder containing La—Y—Re. Reducing temperature was 1130° C. Hydrogen flow was 20 L/min. Rhenium content of tungsten powder containing La—Y—Re was 0.07%.

S6, the tungsten powder containing La—Y—Re was put into mold for isostatic pressing molding to obtain a pressed shape. Pressure of isostatic pressing molding was 85 MPa.

S7, the pressed shape was sintered. Sintering temperature was 2400° C. Atmosphere was hydrogen. Hydrogen flow was 5 L/min. A tungsten rod with diameter of 19.42 mm was then produce.

S8, the tungsten rod in the step S7 was heated to 1200° C., and then rolled to obtain a tungsten rod with a diameter of 9.04 mm.

S9, the tungsten rod in the step S8 was cryogenic treated, The tungsten rod was cooled to −175° C. at the rate of 1.5° C./min. And then temperature was maintained for 80 min. The tungsten rod was forged after cryogenic treatment to obtain the tungsten rod with diameter a tungsten rod with diameter of 3.52 mm. Feeding speed was 2 m/min. Forging speed was 1600 times/min.

S10, the tungsten rod in the step S9 was wiredraw to obtain a tungsten wire containing lanthanum, rhenium and yttrium with a diameter of 35.15 μm.

Figure 2:
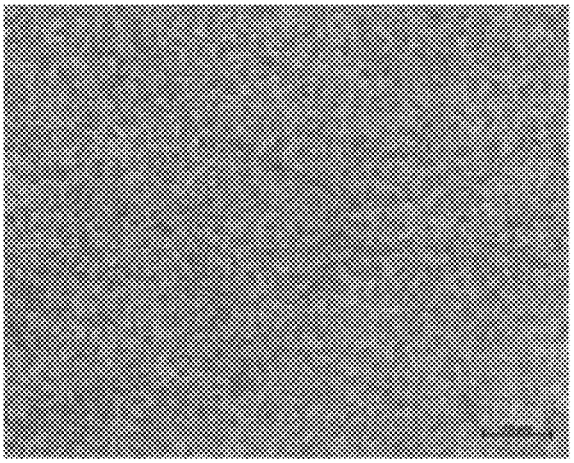
FIG. 2 is a SEM diagram of the tungsten wire prepared by Example 1.

The tungsten wire containing lanthanum, rhenium and yttrium prepared by this example was shown in FIG. 1. And Its SEM diagram was showed in FIG. 2. As shown in FIG. 2, microstructure of the tungsten wire was uniform. After the test, Tension strength was 5462 MPa. Fatigue cycles to failure of fatigue resistance test at 4000 MPa was 74578.

Example 2

The difference between this example and example 1 was that A mass ratio of tungsten:lanthanum:yttrium was 95.2:2.1:1.

Microstructure of the tungsten wire containing lanthanum, rhenium and yttrium prepared by this example was uniform. After the test, Tension strength was 5309 MPa. Fatigue cycles to failure of fatigue resistance test at 4000 MPa was 73564.

Example 3

The differences between this example and example 1 were as follows. Temperature and temperature maintaining time of first calcinating stage were 540° C. and 50 min respectively. Temperature and temperature maintaining time of second calcinating stage were 990° C. and 90 min respectively.

Microstructure of the tungsten wire containing lanthanum, rhenium and yttrium prepared by this example was uniform. After the test, Tension strength was 5386 MPa. Fatigue cycles to failure of fatigue resistance test at 4000 MPa was 73387.

Example 4

The difference between this example and example 1 was that the tungsten rod in the step S9 was wiredraw to obtain a tungsten wire containing lanthanum, rhenium and yttrium with a diameter of 22.30 μm.

Microstructure of the tungsten wire containing lanthanum, rhenium and yttrium prepared by this example was uniform. After the test, Tension strength was 4735 MPa. Fatigue cycles to failure of fatigue resistance test at 4000 MPa was 66595.

Comparative Example 1

The differences between this comparative example and example 1 were as follows. The ammonium paratungstate, the lanthanum nitrate, the yttrium acetate and the ammonium perrhenate were dissolved in water. The aqueous solution was obtained after stirring well. A mass ratio of tungsten:lanthanum:yttrium was 96.1:2.9:1. A mass ratio of the lanthanum to the rhenium was 3.4:1. The Step S4 was not performed in this comparative example.

The rhenium content of the tungsten powder containing lanthanum, rhenium and yttrium prepared by this comparative example was 0.02 wt %, loss of which was extremely high. After the test, Tension strength was 4280 MPa. Fatigue cycles to failure of fatigue resistance test at 4000 MPa was 55855.

Comparative Example 2

The differences between this comparative example and example 1 were that the forging temperature and the temperature maintaining time were 940° C. and 180 min respectively in this comparative example.

The rhenium content of the tungsten powder containing lanthanum, rhenium and yttrium prepared by this comparative example was 0.14 wt %. Part of the lanthanum and the yttrium were decomposed and taken away due to rapidly heating. After the test, Tension strength was 4265 MPa. Fatigue cycles to failure of fatigue resistance test at 4000 MPa was 14680.

Comparative Example 3

The difference between this comparative example and example 1 was that the Step S4 was not performed in this comparative example.

The rhenium content of the tungsten wire containing lanthanum, rhenium and yttrium prepared by this comparative example was 0. The strength of the tungsten wire was low. After the test, Tension strength was 3387 MPa. Fatigue resistance test at 4000 MPa was unable to proceed.

Comparative Example 4

The difference between this comparative example and example 1 was that the yttrium acetate was not added in the step S1.

The yttrium content of the tungsten wire containing lanthanum, rhenium and yttrium prepared by this comparative example was 0. The strength of the tungsten wire was low. After the test, Tension strength was 3294 MPa. Fatigue resistance test at 4000 MPa was unable to proceed.

Comparative Example 5

The difference between this comparative example and example 1 was that A mass ratio of the lanthanum to the rhenium was 1:1 in this comparative example.

Tension strength of the tungsten wire containing lanthanum, rhenium and yttrium prepared by this comparative example was 3294 MPa. Fatigue resistance test at 4000 MPa was unable to proceed.

Comparative Example 6

The difference between this comparative example and example 1 was that Pressure of isostatic pressing was 30 MPa in this comparative example.

Molding ratio of the press shape prepared by this comparative example was low. Cracks were occurred during sintering process, which failed to molding.

Comparative Example 7

The difference between this comparative example and example 1 was that the cryogenic treatment in the Step S9 was not performed in this comparative example.

The tungsten roll was forged by 11 times, 4 times of which was finished. Cracks were occurred in 7 times of the forging.

Comparative Example 8

The differences between this comparative example and example 1 were as follows. Tungsten powder, lanthanum oxide, rhenium oxide and yttrium oxide were used as raw materials. Solid-solid mixing doping was performed according to a mass ratio of Example 1. Procedures after doping started from step S5 of Example 1.

Figure 3:
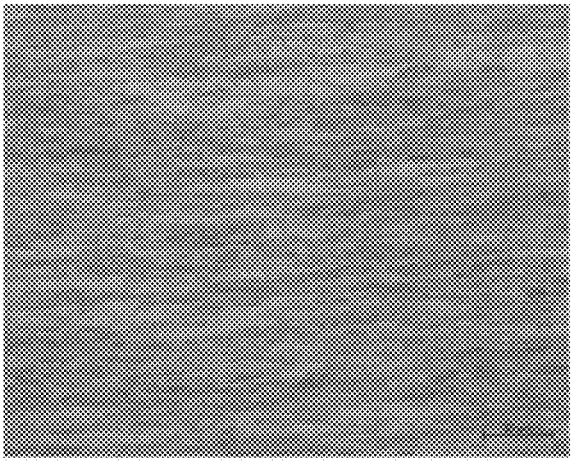
FIG. 3 is a SEM diagram of the tungsten wire prepared by Comparative Example 8.

SEM diagram of the tungsten wire containing lanthanum, rhenium and yttrium prepared by this comparative example was showed in FIG. 3. As shown in FIG. 3, microstructure of the tungsten wire was nonuniform. After the test, tension strength was 3695 MPa. Fatigue cycles to failure of fatigue resistance test at 4000 MPa was 74578. Fatigue resistance test at 4000 MPa was unable to proceed.

As shown in above-mentioned examples and comparative example, the lanthanum and the yttrium were doped uniformly by doping the lanthanum and the yttrium in manner of liquid to liquid. W—La—Y compound powder with uniform composition distribution was obtained after oxidizing process. The rhenium element loss caused by rhenium oxides formation at early stage of oxidizing process was avoided by mixing rhenium at late stage which also ensured effective addition of the rhenium element. The property decay caused by stress concentration formed by doping elements was decreased by the uniform composition distribution which also improved the tension strength and fatigue resistance property of the tungsten wire. The tension strength of the tungsten wire containing lanthanum, rhenium and yttrium according to the present disclosure was 4600-6000 MPa. Fatigue cycles to failure of fatigue resistance test at 4000 MPa was not less than 65000.

The descriptions mentioned above are only some preferred embodiments of the present disclosure, which doesn't limit the claim scale of the present disclosure. The claim scale of the present disclosure contains any changes with same effects, direct or indirect application in other field according to the solutions of the present disclosure.

What is claimed is:

1. A preparation method of tungsten wire containing lanthanum, rhenium, yttrium and tungsten, characterized in that the method contains the following steps:

S1, dissolving water soluble tungsten source, lanthanum source and yttrium source in water, stirring them well to obtain an aqueous solution; a mass ratio of tungsten in the tungsten source:lanthanum in the lanthanum source:yttrium in the yttrium source is (95.2-99.5):(2.2-2.9):1;

S2, spray granulating the aqueous solution to obtain W—La—Y compound powder;

S3, oxidizing calcinating the compound powder to obtain W—La—Y oxide compound powder; the calcinating proceeds in stages; temperature and temperature maintaining time of first calcinating stage are 450-540° C. and 50-100 min respectively; temperature and temperature maintaining time of second calcinating stage are 950-990° C. and 90-160 min respectively;

S4, adding rhenium to the W—La—Y oxide compound powder by spraying and mixing the W—La—Y oxide compound powder and rhenium solution to obtain W—La—Y oxide compound powder containing Re; a mass ratio of the lanthanum to the rhenium of (3.3-3.6):1;

S5, reducing the W—La—Y oxide compound powder containing Re by hydrogen to obtain tungsten powder containing La—Y—Re;

S6, putting the tungsten powder containing La—Y—Re into a mold for isostatic pressing molding to obtain a pressed shape;

S7, sintering the pressed shape, and then producing tungsten rod with a diameter of 19.5±0.3 mm;

S8, heating and then rolling the tungsten rod in the step S7 to obtain a tungsten rod with a diameter of 9±0.5 mm;

S9, treating the tungsten rod in the step S8 with cryogenic treatment, and then forging it to obtain a tungsten rod with a diameter of 3.5±0.2 mm;

S10, wiredrawing the tungsten rod in the step S9 to obtain tungsten wire containing lanthanum, rhenium and yttrium.

2. A preparation method of tungsten wire containing lanthanum, rhenium and yttrium tungsten according to claim 1, characterized in that in the step S5, reducing temperature is 1120-1180° C.; hydrogen flow is 20-28 L/min.

3. A preparation method of tungsten wire containing lanthanum, rhenium and yttrium tungsten according to claim 1, characterized in that sintering temperature is 2400-2600° C.; atmosphere of sintering is hydrogen; hydrogen flow is 2-5 L/min.

4. A preparation method of tungsten wire containing lanthanum, rhenium and yttrium tungsten according to claim 1, characterized in that in the step S9, the cryogenic treatment is cooling to −175~−178° C. at a rate of 1.5-2.5° C./min and then maintaining for 80-110 min.

5. A preparation method of tungsten wire containing lanthanum, rhenium and yttrium tungsten according to claim 1, characterized in that in the step S9, a feeding speed of the forging is 0.6-3 m/min; a forging speed is 1000-3000 times/min.

* * * * *